US005401041A

United States Patent [19]

Jespersen

[11] Patent Number: 5,401,041

[45] Date of Patent: Mar. 28, 1995

[54] BOOT BINDING SYSTEM FOR A SNOWBOARD

[76] Inventor: Randy Jespersen, R.R. #1, Spruce Grove, Alberta, Canada, T7X 2T4

[21] Appl. No.: 192,825

[22] Filed: Feb. 7, 1994

[30] Foreign Application Priority Data

Feb. 11, 1993 [CA] Canada ..... 2089313

[51] Int. Cl.[6] ..... A63C 5/03; A63C 9/00

[52] U.S. Cl. ..... 280/14.2; 280/619; 280/623; 280/11.36

[58] Field of Search ..... 280/14.2, 619, 621, 280/623, 633, 11.36, 611

[56] References Cited

U.S. PATENT DOCUMENTS

| | | | |
|---|---|---|---|
| 1,156,174 | 10/1915 | Rall | 280/619 X |
| 2,153,809 | 4/1939 | Meis | 280/619 |
| 2,301,476 | 11/1942 | Sutherland | 280/11.36 |
| 2,546,694 | 3/1951 | Johansen | 280/619 |
| 3,235,978 | 2/1966 | Hyde | 280/11.36 X |
| 3,838,866 | 10/1974 | D'Alessio et al. | 280/623 X |
| 3,936,063 | 2/1976 | Sittmann | 280/619 |
| 4,013,304 | 3/1977 | Begey et al. | 280/623 X |

FOREIGN PATENT DOCUMENTS

| | | | |
|---|---|---|---|
| 3811096 | 10/1989 | Germany | 280/14.2 |
| 4106401 | 9/1992 | Germany | 280/14.2 |
| 226947 | 8/1943 | Switzerland | 280/623 |

*Primary Examiner*—Brian L. Johnson
*Attorney, Agent, or Firm*—Anthony R. Lambert

[57] ABSTRACT

A boot binding system for a snowboard includes a rigid heel support adapted for attachment to a heel of a boot. The heel support has a protruding member. A rigid ankle support is provided which is adapted for attachment along a rear spine of a boot. The ankle support is pivotally secured to the heel support, such that the ankle support pivots laterally, and flexes forwardly, while providing rigid support rearwardly. A heel binding is provided having an overlay member which overlays the protruding member thereby preventing the heel of the boot from being raised. A toe binding is provided which is adapted to secure a toe of a boot to a snowboard thereby preventing the protruding member from being moved relative to the overlay member.

7 Claims, 4 Drawing Sheets

BOOT BINDING SYSTEM FOR A SNOWBOARD

The present invention relates to a boot binding system for a snowboard.

BACKGROUND OF THE INVENTION

Snowboards are sliding apparatus used to slide down snow covered slopes. They resemble miniature surfboards and are manoeuvred by transferring body weight in the same fashion as a surfboard or a skateboard. It is extremely difficult to manoeuvre a snowboard unless ones feet at affixed to the snowboard, due to the pitch of the slope, and the inability of the boot to grip the snowboard especially when the snowboard and the sole of the boot are covered in snow. Bindings are used to affix the boots of the snowboarder to the snowboard.

The snowboarder stands sideways on the snowboard. The foot nearest a front of the snowboard is referred to as a front foot. The foot nearest a back of the snowboard is referred to as a back foot. A hand of a snowboarder nearest the front of the snowboard is referred to as a leading hand. The hand nearest the rear of the snowboard is referred to as the trailing hand. An edge nearest toes of a snowboarder is referred to as a toe edge. The edge nearest heels of a snowboarder is referred to as a heel edge.

Snowboarders compete in competitions in which trick maneuvers are performed. These trick maneuvers have exotic names such as "melancholy", "tail grab", and "method air". When doing the "melancholy" the snowboarder grabs the snowboard on the heel edge with his leading hand positioned between the front foot and back foot. The back leg is bent, and the front leg is kept straight to push the snowboard in front of the snowboarder. When doing the "tail grab" the snowboarder grabs the back or tail of the snowboard with his trailing hand. When doing the "method air" the snowboarder bends his knees behind him and places his lead hand slightly in front of the front foot. The snowboard assumes a back scratching position behind the snowboarder. These maneuvers are extremely demanding and require considerable flexibility on the part of the snowboarder. Existing binding systems inhibit the flexibility of the snowboarder and, hence, the ability of the snowboarder to perform these competitive trick maneuvers.

SUMMARY OF THE INVENTION

What is required is a boot binding system better adapted for use in competitive snowboarding.

According to the present invention there is provided a boot binding system for a snowboard including a rigid heel support adapted for attachment to a heel of a boot. The heel support has a protruding member. A rigid ankle support is provided which is adapted for attachment along a rear spine of a boot. The ankle support is pivotally secured to the heel support, such that the ankle support pivots laterally, and flexes forwardly, while providing rigid support rearwardly. A heel binding is provided having an overlay member which overlays the protruding member thereby preventing the heel of the boot from being raised. A toe binding is provided which is adapted to secure a toe of a boot to a snowboard thereby preventing the protruding member from being moved relative to the overlay member.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
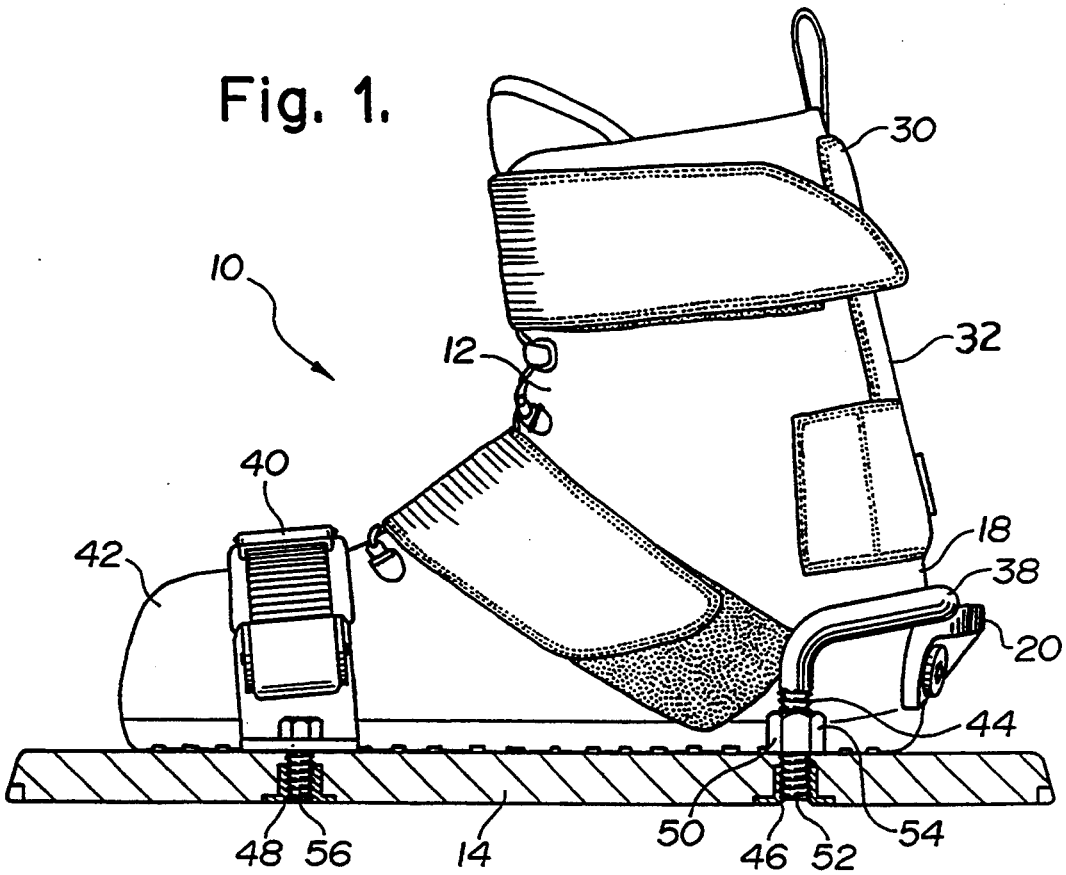
FIG. 1 is a side elevation view of a boot binding system of a snowboard constructed in accordance with the teachings of the present invention.

The preferred embodiment, a boot binding system for a snow board generally identified by reference numeral 10, will now be described with reference to FIGS. 1 through 4.

Figure 2:
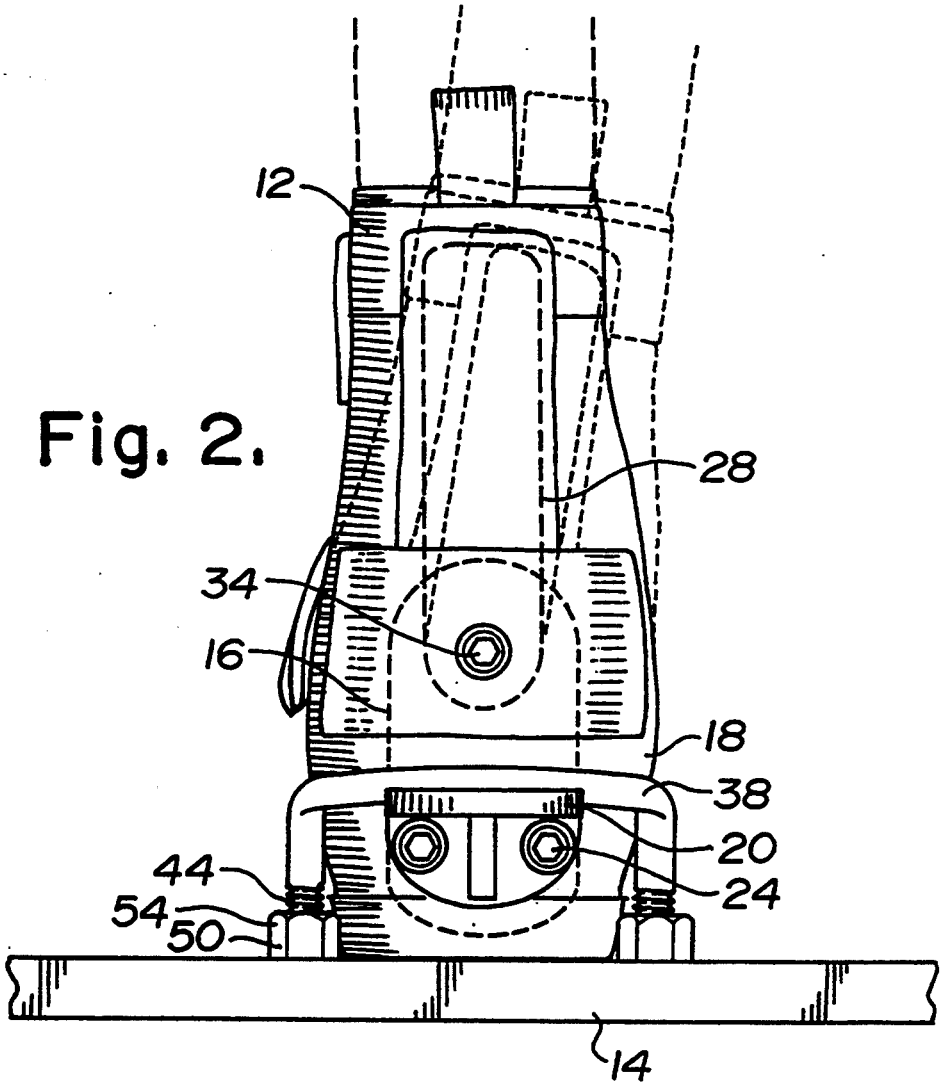
FIG. 2 is a rear elevation view of the boot binding system illustrated in FIG. 1.
Figure 3:
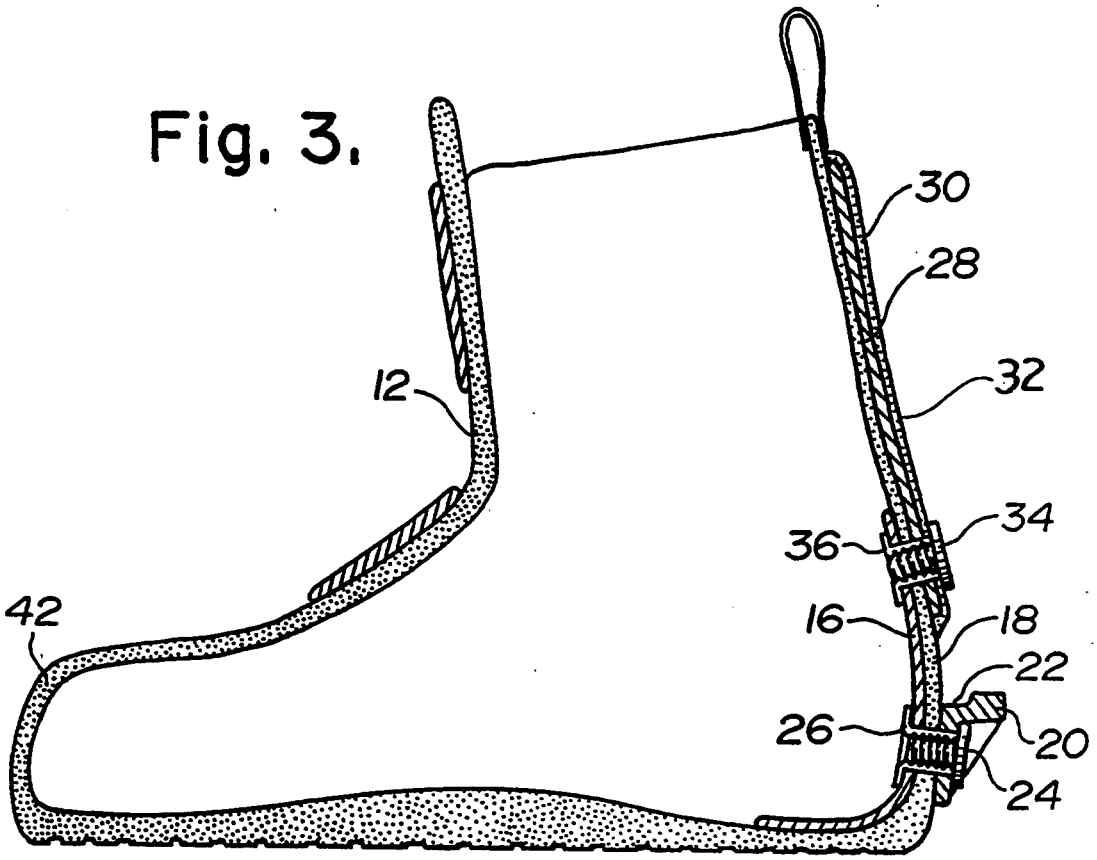
FIG. 3 is a side elevation view in longitudinal section of the boot binding system in FIG. 1.
Figure 4:
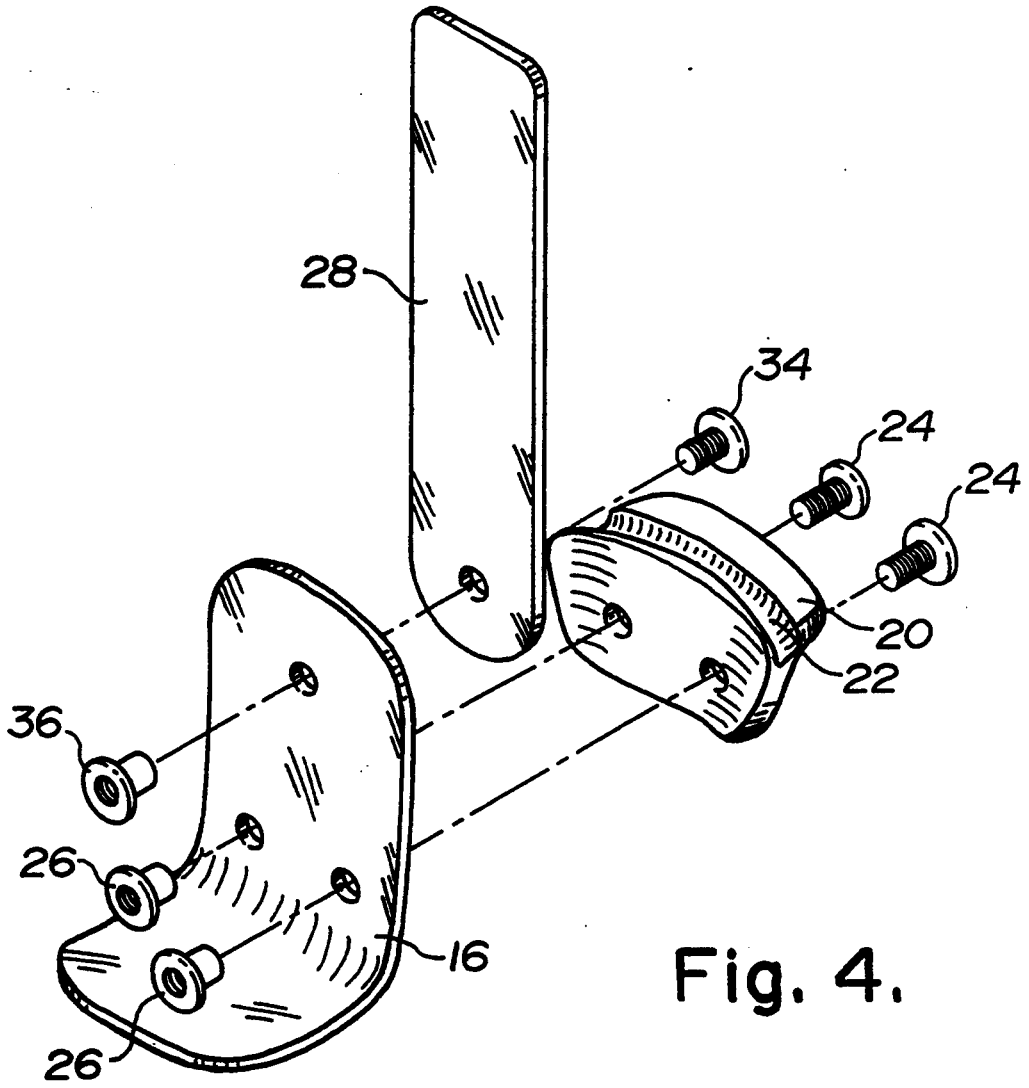
FIG. 4 is an exploded perspective view of components of the boot binding system illustrated in FIG. 1.

Boot binding system 10 is intended to securely position a boot 12 onto a snowboard 14. Referring to FIGS. 2 and 4, boot binding system 10 includes a rigid heel support 16. Heel support 16 is adapted for attachment to a heel 18 of boot 12. Heel support 16 has an attached protruding member 20 with a channel 22. Referring to FIG. 3, heel support 16 is secured heel 18 of boot 12 and to protruding member 20 by means of bolts 24 and nuts 26. A rigid ankle support 28 is adapted for insertion in an elongate pocket 30 positioned along a rear spine 32 of boot 12. Ankle support 28 is pivotally secured to heel support 16 by means of nut 34 and bolt 36. Referring to FIGS. 1 and 2, a heel binding is provided which consists of a generally "U" shaped overlay member 38 which wraps around heel 18 of boot 12 and overlays protruding member 20 engaging channel 22. A toe binding is provided consisting of an attachment strap 40 adapted to secure a toe 42 of boot 12 to snowboard 14. Generally "U⇄ shaped overlay member 38 has threaded end portions 44. Snowboard 14 has threaded apertures 46 and 48. A coupling member 50 is used to attach generally "U" shaped overlay member 38 to snowboard 14. Coupling member 50 has a bolt-like male end 52 and a nut-like female end 54. Male end 52 is insertable into threaded apertures 46. Female end 54 receives threaded end portions 44 of generally "U" shaped overlay members 38. Coupling member 50 has threads cut in opposing directions such that as coupling member 50 is rotated coupling member 50 is drawn into apertures 46 in snowboard 14 while concurrently threaded end portion 44 of generally "U" shaped overlay member 38 is drawn into female end 54 of coupling member 50. Attachment strap 40 is attached to apertures 48 in snowboard 14 by means of bolts 56.

The use and operation of boot binding system 10 will now be described with reference to FIG. 1 through 4. Boot binding system 10 is comparatively easy to get in and out of. This is significant in that a snowboarders means of propulsion on a level surface is to get one leg free and push with the free foot in the manner of a skateboard. The snowboarder merely inserts protruding member 20 under generally "U" shaped overlay member 38. Generally "U" shaped overlay member 38 wraps around heel 18 of boot 12 and overlays protruding member 20 engaging channel 22. Once overlay member 38 is engaged in channel 22 heel 18 of boot 12 cannot be raised. Attachment strap 40 is then fastened down over toe 42 of boot 12, this secures toe 42 of boot 12 to snowboard 14 and prevents protruding member 20 from being moved relative to overlay member 38. In response to movement of the snowboarder ankle support 28 pivots laterally and flexes forwardly. However, if the snowboarder leans rearwardly, ankle support 28 provides needed rigid support rearwardly. Once on a level surface, the snowboarder merely unbuckles attachment strap 40, raises his toes to disengage overlay member 38 from channel 22 and slides his foot forward to remove protruding member 20 from overlay member 38.

It will be apparent to one skilled in the art that boot binding system 10 provides a degree of flexibility needed to perform trick maneuvers while provided sufficient support to enable the snowboarder to maintain his balance. It will also be apparent to one skilled in the art that modifications may be made to the illustrated embodiment without departing from the spirit and scope of the invention as defined by the claims.

The embodiments of the invention in which an exclusive property or privilege is claimed are as follows:

1. A boot binding system for a snowboard, comprising:

a. a rigid heel support adapted for attachment to a heel of a boot, the heel support having a rearwardly protruding member such that the member protrudes rearwardly from the heel of the boot to which the protruding member is attached;

b. a rigid ankle support adapted for attachment along a rear spine of a book, the ankle support being pivotally secured to the heel support, such that the ankle support pivots laterally, flexes forwardly, while providing rigid support rearwardly to the rear spine of the boot;

c. a heel binding having end portions adapted for attachment to a snow board and an overlay member extending between the end portions at a height a fractional amount greater than the protruding member such that the overlay member overlays the protruding member thereby preventing the heel of the boot from being raised from the surface of the snowboard; and d. a toe binding adapted for attachment to a snowboard in spaced relation to the heel binding, the toe binding securing a toe of a boot to a snowboard when the protruding member is engaged by the overlay member, thereby preventing the protruding member from being moved axially relative to the overlay member and inadvertently disengaged.

2. The boot binding system for a snowboard as defined in claim 1, the overlay member being a generally "U" shaped member.

3. The boot binding system for a snowboard as defined in claim 1, the ankle support being positioned in an elongate pocket along the rear spine of the boot.

4. The boot binding system for a snowboard as defined in claim 2, the protruding member having an integrally formed channel adapted to receive the generally "U" shaped overlay member.

5. The boot binding system for a snowboard as defined in claim 2, the generally "U" shaped member having threaded end portions, the snowboard having threaded apertures, and a coupling member being used to attach the generally "U" shaped overlay member to the snowboard, the coupling member having a bolt-like male end and a nut-like female,end, the male end being insertable into the threaded apertures, the female end receiving the threaded end portions of the generally "U" shaped members, the coupling member having threads cut in opposing directions such that as the coupling member is rotated the coupling member is drawn into the apertures in the snowboard while concurrently the threaded end portion of the generally "U" shaped overlay member is drawn into the female end of the coupling member.

6. A boot binding system for a snowboard, comprising:

a. a rigid heel support adapted for attachment to a heel of a boot, the heel support having a protruding member with an integrally formed channel; such that the protruding member with the integrally formed channel protrudes rearwardly from the heel of the boot to which the protruding member is attached;

b. a rigid ankle support adapted for insertion in an elongate pocket positioned along a rear of a boot, the ankle support being pivotally secured to the heel support, such that the ankle support pivots laterally, flexes forwardly, while providing rigid support rearwardly to the rear spine of the boot;

c. a heel binding having end portions adapted for attachment to a snowboard and a generally "U" shaped overlay member extending between the end portions at a height a fractional amount greater than the protruding member such that the overlay member wraps around the heel of the boot and overlays the protruding member engaging the channel thereby preventing the heel of the boot from being raised from the surface of the snowboard; and d. a toe binding adapted for attachment to a snowboard in spaced relation to the heel binding, the toe binding securing a toe of a boot to the snowboard when the protruding member is engaged by the overlay member thereby preventing the protruding member from being moved axially relative to the overlay member and inadvertently disengaged.

7. The boot binding system for a snowboard as defined in claim 6, the generally "U" shaped overlay member having threaded end portions, the snowboard having threaded apertures, and a coupling member being used to attach the generally "U" shaped overlay member to the snowboard, the coupling member having a bolt-like male end and a nut-like female end, the male end being insertable into the threaded apertures, the female end receiving the threaded end portions of the generally "U" shaped overlay members, the coupling member having threads cut in opposing directions such that as the coupling member is rotated the coupling member is drawn into the apertures in the snowboard while concurrently the threaded end portion of the generally "U" shaped overlay member is drawn into the female end of the coupling member.

* * * * *